US009770103B2

(12) United States Patent
Cochran et al.

(10) Patent No.: US 9,770,103 B2
(45) Date of Patent: Sep. 26, 2017

(54) SHELF MOVABLE BETWEEN AN EXTENDED SHELF POSITION AND A SHELF STORAGE POSITION

(71) Applicant: HEWLETT PACKARD ENTERPRISE DEVELOPMENT LP, Houston, TX (US)

(72) Inventors: Charles W Cochran, Spring, TX (US); Chris F Felcman, Magnolia, TX (US)

(73) Assignee: Hewlett Packard Enterprise Development LP, Houston, TX (US)

( * ) Notice: Subject to any disclaimer, the term of this patent is extended or adjusted under 35 U.S.C. 154(b) by 0 days.

(21) Appl. No.: 15/314,079

(22) PCT Filed: Jun. 30, 2014

(86) PCT No.: PCT/US2014/044778
§ 371 (c)(1),
(2) Date: Nov. 26, 2016

(87) PCT Pub. No.: WO2016/003387
PCT Pub. Date: Jan. 7, 2016

(65) Prior Publication Data

US 2017/0156494 A1 Jun. 8, 2017

(51) Int. Cl.

| | |
|---|---|
| ***A47F 5/12*** | (2006.01) |
| ***A47B 46/00*** | (2006.01) |
| ***A47B 96/02*** | (2006.01) |
| ***A47B 57/40*** | (2006.01) |

(52) U.S. Cl.
CPC ..... *A47B 46/005* (2013.01); *A47B 57/406* (2013.01); *A47B 96/021* (2013.01); *A47B 96/024* (2013.01)

(58) Field of Classification Search
CPC ..... A47B 5/04; A47B 46/005; A47B 57/04; A47B 57/045; A47B 57/40; A47B 57/406; A47B 63/021; A47B 63/024; A47B 96/021; A47B 96/024; A47F 5/0037;
(Continued)

(56) References Cited

U.S. PATENT DOCUMENTS 1,805,989 A * 5/1931 Levene ..... A47B 57/045 108/1
1,852,723 A * 4/1932 Orton ..... A47B 5/04 108/134
(Continued)

FOREIGN PATENT DOCUMENTS

EP 2554094 2/2013

OTHER PUBLICATIONS

"Rack Shelves & Drawers," Cableorganizer.Com, Retrieved from Internet May 21, 2014, http://www.cableorganizer.com/computer-cabinets/rack-mount-shelves.htm.
(Continued)

*Primary Examiner* — Hanh V Tran
(74) *Attorney, Agent, or Firm* — Hewlett Packard Enterprise Patent Department

(57) ABSTRACT

A shelving apparatus includes a shelf and a kickstand member. The shelf includes a first set of shelf connectors and a second set of shelf connectors. The shelf is movable between a plurality of shelf positions including an extended shelf position and a shelf storage position.

15 Claims, 7 Drawing Sheets

(58) Field of Classification Search
CPC .... A47F 5/0081; A47F 5/0815; A47F 5/0823; A47F 5/10; A47F 5/12
See application file for complete search history.

(56) References Cited

U.S. PATENT DOCUMENTS

| | | | | | |
|---|---|---|---|---|---|
| 2,199,981 | A * | 5/1940 | Bell | A47B 5/04 | 108/134 |
| 3,125,042 | A * | 3/1964 | Mapson | A47B 57/045 | 108/135 |
| 3,209,709 | A * | 10/1965 | Shoffner | A47F 5/103 | 108/108 |
| 3,485,382 | A * | 12/1969 | Larson | A47B 57/045 | 108/107 |
| 3,508,665 | A * | 4/1970 | Sobel | A47B 57/045 | 211/150 |
| 3,973,678 | A * | 8/1976 | Nesbitt | A47F 5/0823 | 211/106 |
| 4,492,169 | A * | 1/1985 | Ware | A47B 57/045 | 108/108 |
| 4,944,390 | A * | 7/1990 | Baucom | A47F 5/0815 | 206/362 |
| 5,022,539 | A * | 6/1991 | Rushing | A47F 5/12 | 108/108 |
| 5,529,192 | A * | 6/1996 | Conen | A47F 5/0815 | 211/187 |
| 6,026,752 | A * | 2/2000 | Zachrai | A47B 5/02 | 100/42 |
| 6,179,136 | B1 * | 1/2001 | Kluge | A47B 57/30 | 211/103 |
| 6,343,834 | B1 | 2/2002 | Wurmlinger | | |
| 6,581,788 | B1 | 6/2003 | Winig | | |
| 6,584,916 | B1 * | 7/2003 | Felton | A47B 46/005 | 108/107 |
| 6,705,235 | B1 | 3/2004 | Gerutto | | |
| 7,278,229 | B1 | 10/2007 | Fen | | |
| 7,966,948 | B1 | 6/2011 | Galietti | | |
| 8,584,601 | B1 * | 11/2013 | Deschner | B25H 1/04 | 108/134 |
| 2002/0043187 | A1 * | 4/2002 | Felton | A47B 46/005 | 108/107 |
| 2012/0037583 | A1 * | 2/2012 | Wise | A47B 46/005 | 211/150 |
| 2012/0248049 | A1 | 10/2012 | Moore | | |
| 2012/0281352 | A1 | 11/2012 | Namek et al. | | |
| 2013/0306269 | A1 | 11/2013 | Helbig et al. | | |
| 2014/0263128 | A1 * | 9/2014 | Garrett | A47F 5/0087 | 211/144 |

OTHER PUBLICATIONS

PCT/ISA/KR, International Search Report dated Mar. 31, 2105, PCT/US2014/044778, 10 pps.

* cited by examiner

SHELF MOVABLE BETWEEN AN EXTENDED SHELF POSITION AND A SHELF STORAGE POSITION

BACKGROUND

Shelves are used to place objects such as computers thereon. Shelves may be incorporated into mobile structures such as carts to relocate the shelves and the objects placed thereon to different locations.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Shelves are used to place objects such as computers thereon. Shelves may be incorporated into mobile structures such as carts to relocate the shelves and the objects placed thereon to different locations. For example, in data centers, shelves may be incorporated into crash carts to hold computers thereon. The crash cart may be rolled to different locations in the data center to access respective racks housing equipment including servers and the like. The computers may connect to and communicate with the respective equipment housed in the racks to troubleshoot equipment issues. Traditionally, crash carts are used to hold computers for troubleshooting. However, crash carts in data centers take up valuable space. Also, relocating the crash cart throughout the data center may be cumbersome and time consuming. Thus, such inefficient use of time and space reduces the amount of time to diagnose equipment problems.

In examples, a shelving apparatus includes a shelf and a kickstand member. The shelf is movable between a plurality of shelf positions including an extended shelf position and a shelf storage position. The shelf includes a shelf surface, a first set of shelf connectors, and a second set of shelf connectors. The first set of shelf connectors removably couples to a perforated member in the extended shelf position. The second set of shelf connectors removably couples to the perforated member in the shelf storage position.

The kickstand member is movable between a plurality of kickstand positions including an extended kickstand position and a kickstand storage position. The kickstand member includes a first end to couple to the shelf and a second end having at least one kickstand connector to removably couple to the perforated member. Thus, the shelf may be conveniently moved to and/or stored at desired locations. The shelf may also be adjustably positioned at the desired location to receive objects such as computers without having to be incorporated into a mobile structure such as a crash cart, and the like. Thus, such efficient use of time and space increases the amount of time to diagnose equipment problems.

Figure 1:
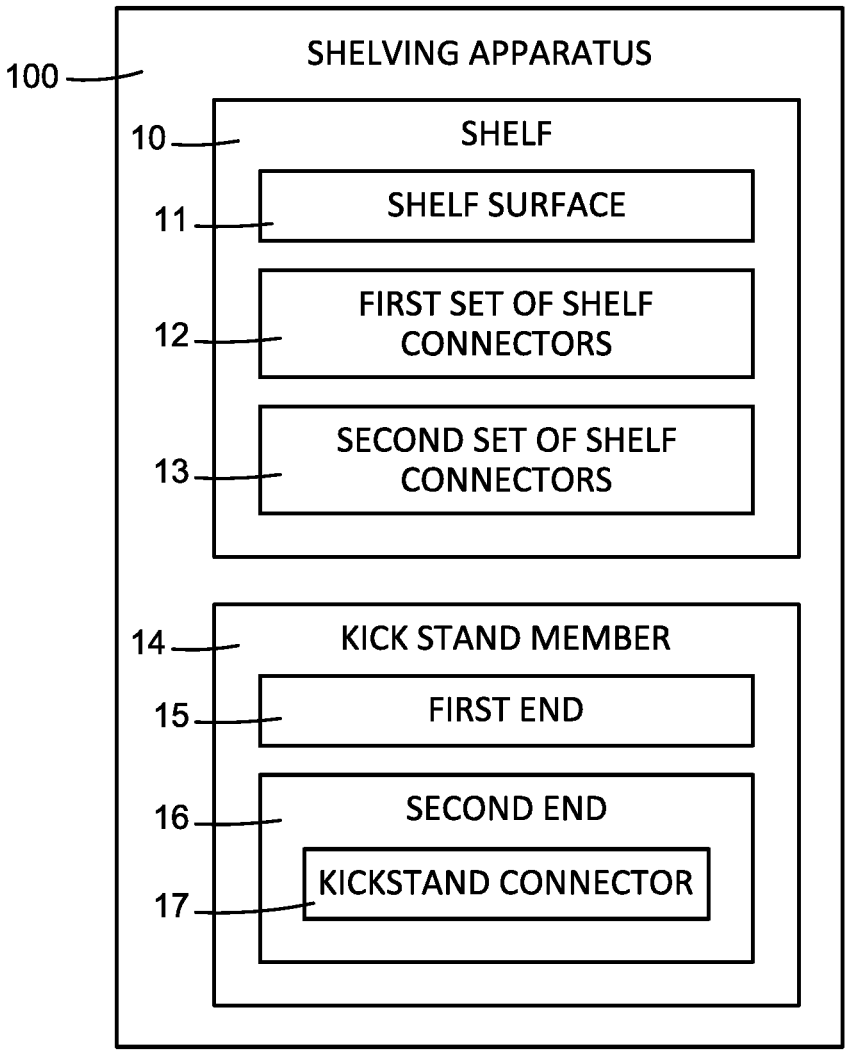
FIG. 1 is a block diagram illustrating a shelving apparatus according to an example.

FIG. 1 is a block diagram illustrating a shelving apparatus according to an example. Referring to FIG. 1, in some examples, a shelving apparatus 100 includes a shelf 10 and a kickstand member 14. The shelf 10 is movable between a plurality of shelf positions including an extended shelf position and a shelf storage position. For example, in the extended shelf position, the shelf 10 may connect to a perforated member and extend outward therefrom to receive an object thereon. In some examples, the extended shelf position may correspond to the shelf surface 11 disposed in a horizontal orientation. Alternatively, in some examples, the shelf 10 may connect to the perforated member in the shelf storage position and not extend outward therefrom. That is, in the shelf storage position, the shelf 10 may be placed parallel to perforated member and not receive an object thereon. For example, the shelf storage position may correspond to the shelf surface 11 disposed in a vertical orientation.

Referring to FIG. 1, in some examples, the shelf 10 includes a shelf surface 11, a first set of shelf connectors 12, and a second set of shelf connectors 13. The shelf surface 11, for example, may be planar to receive an object thereon in the extended shelf position. The first set of shelf connectors 12 removably couples to the perforated member in the extended shelf position. The second set of shelf connectors removably couples to the perforated member in the shelf storage position.

Referring to FIG. 1, in some examples, the kickstand member 14 is movable between a plurality of kickstand positions including an extended kickstand position and a kickstand storage position. The extended kickstand position may correspond to the kickstand member 14 disposed in an inclined orientation with respect to the perforated member 39. The kickstand storage position may correspond to the kickstand member 14 disposed in a vertical orientation. The kickstand member 14 includes a first end 15 and a second end 16. The first end 15 is coupled to the shelf 10. The second end 16 includes at least one kickstand connector 17 to removably couple to the perforated member. In some examples, the perforated member may include a rack door to restrict access and allow air flow to equipment such as server equipment housed by racks in a data center. The second set of shelf connectors 13 removably couples to the perforated member in the shelf storage position.

Figure 2:
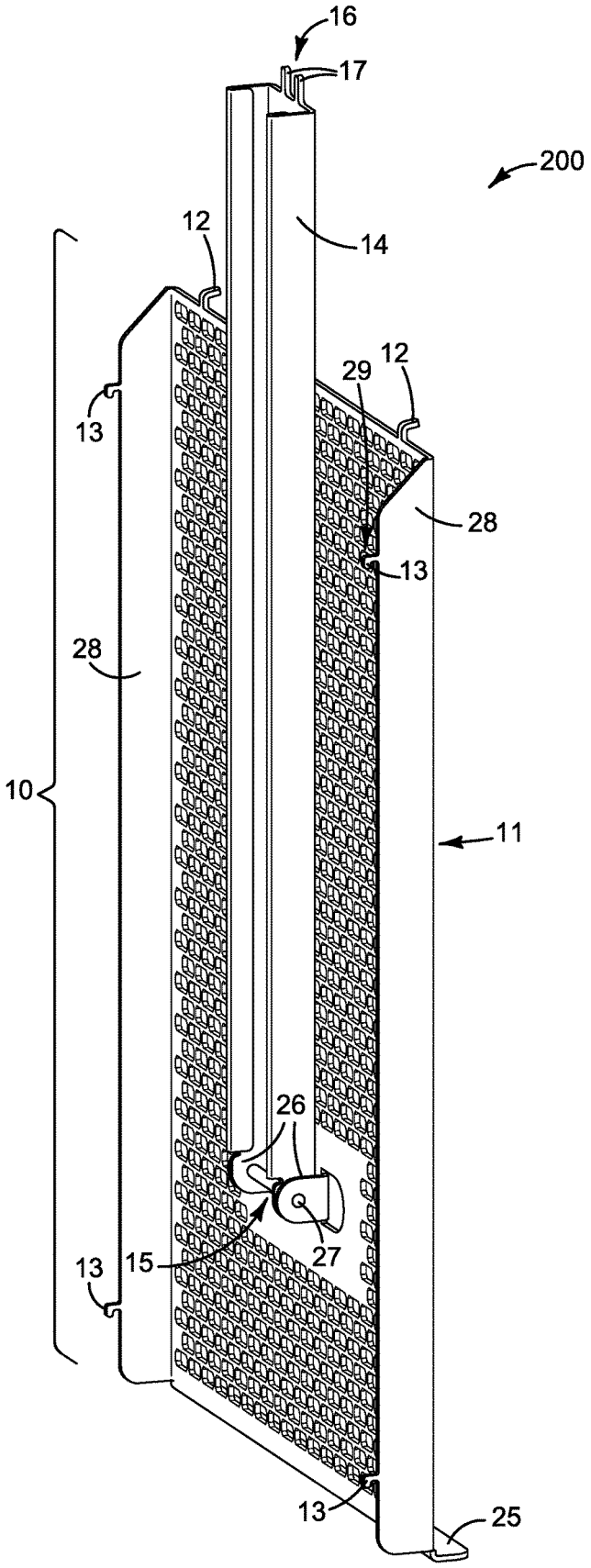
FIG. 2 is a schematic view illustrating a shelving apparatus according to an example.

FIG. 2 is a schematic view illustrating a shelving apparatus according to an example. Referring to FIG. 2, in some examples, the shelf 10 may also include a plurality of side rails 28, an area 29 to receive the kickstand member 14 in the kickstand storage position, a front rail 25, a plurality of flanges 26, a first set of shelf connectors 12, and a second set of shelf connectors 13. The side rails 28 may be attached to and extend outward from the shelf surface 11. The side rails 28 and the shelf surface 11 may form an area 29 to receive the kickstand member 14 in a kickstand storage position.

Referring to FIG. 2, in some examples, the front rail 25 may be attached to and extend outward from the shelf surface 11 in a direction opposite from the side rails 28 disposed along opposite ends of the shelf surface 11. The flanges 26 may extend outward from the shelf surface 11 to connect to the first end 15 of the kickstand member 14. In some examples, a fastener 27 such as a bolt may movably connect the flanges 26 to the first end 15 of the kickstand member 14. In some examples, the shelf surface 11 may include a perforated surface. For example, in the shelf storage position, the perforated surface may enable air flow to pass through the perforated member. Also, in the extended shelf position, the perforated surface may also enable objects such as computers to be placed thereon. In some examples, the shelf 10 may be formed of metal.

Figure 3A:
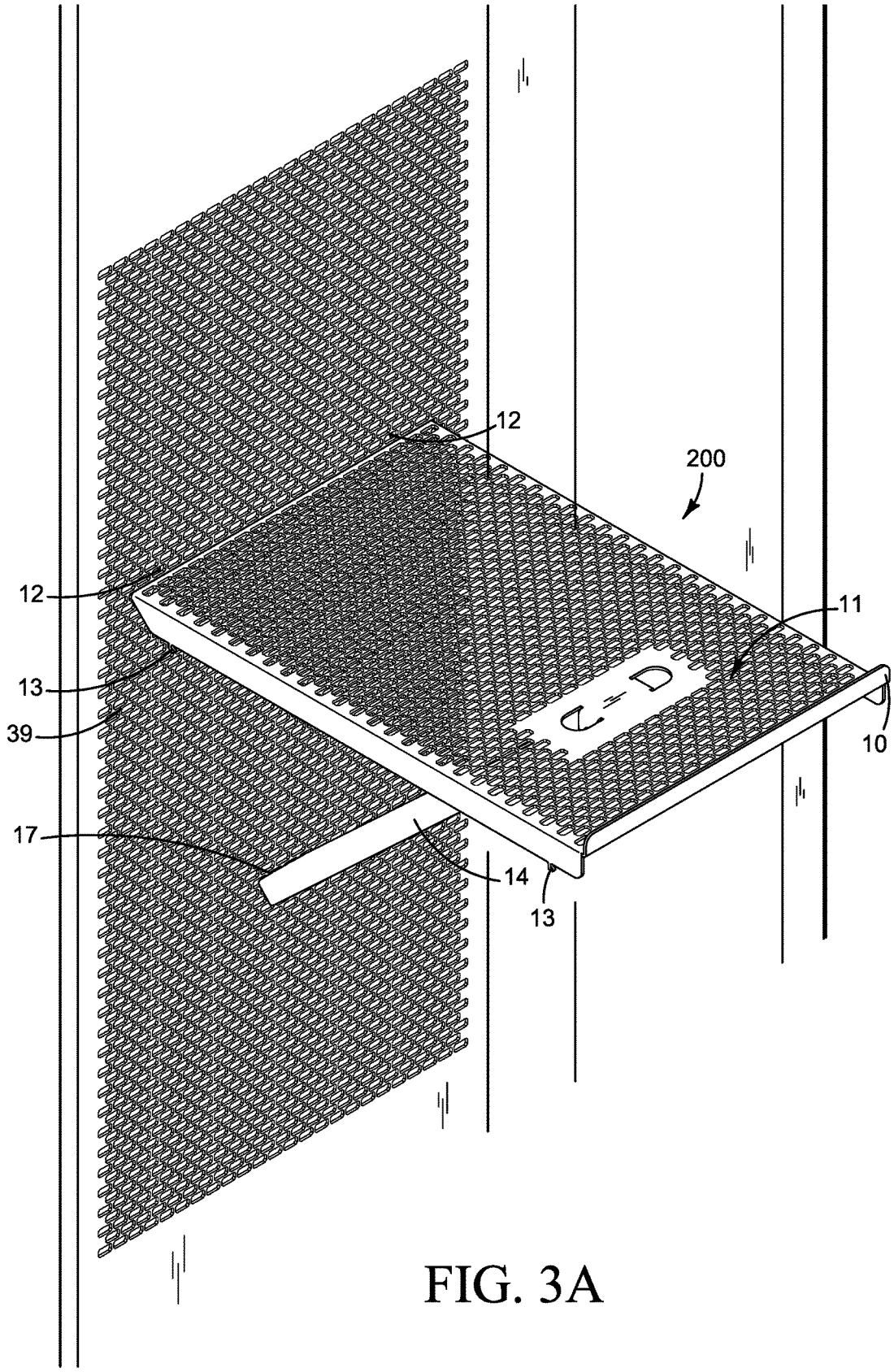
FIGS. 3A-3C are schematic views illustrating the shelving apparatus of FIG. 2 in a plurality of shelf positions, respectively, according to examples.
Figure 3B:
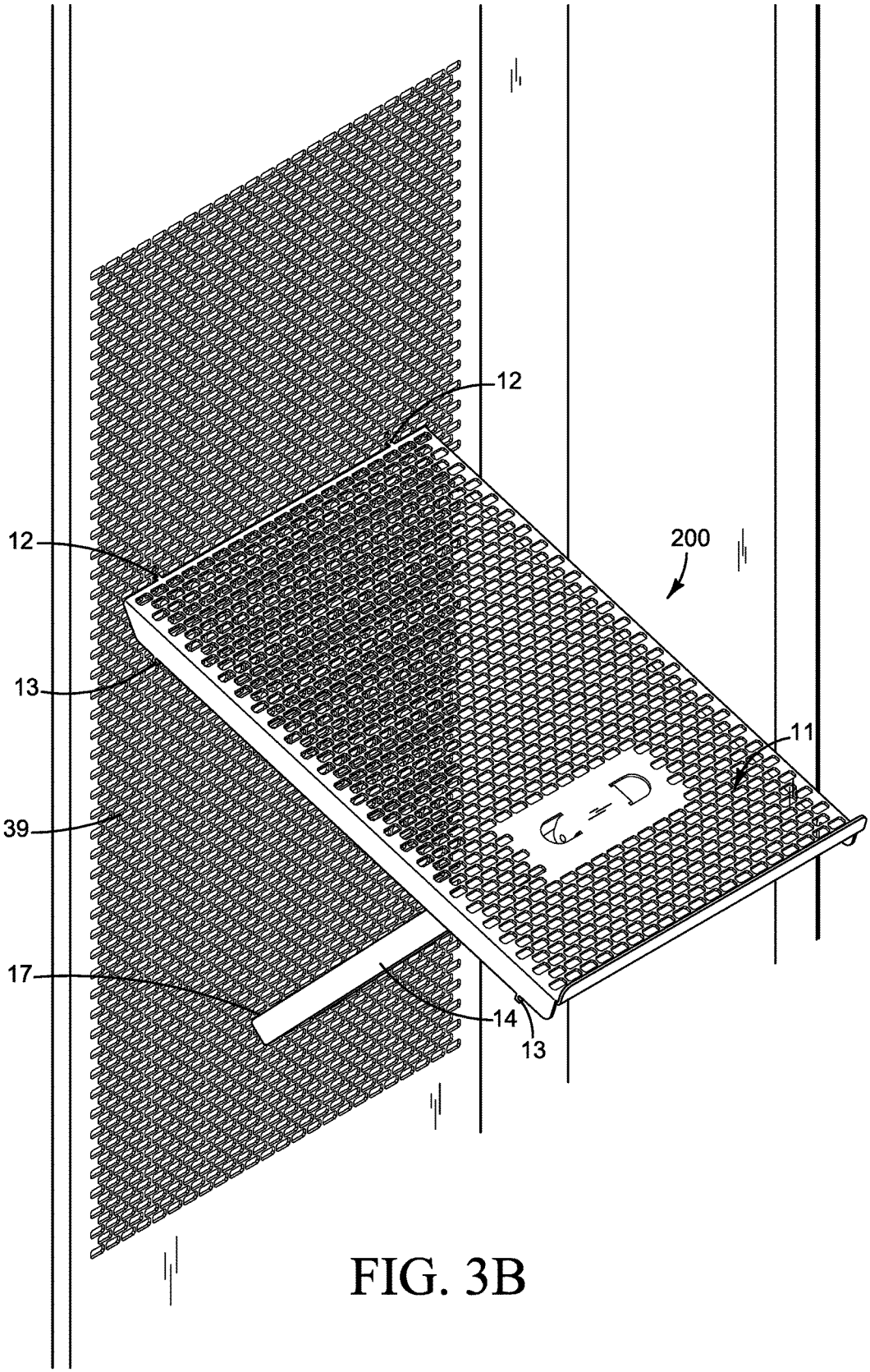
Figure 3C:
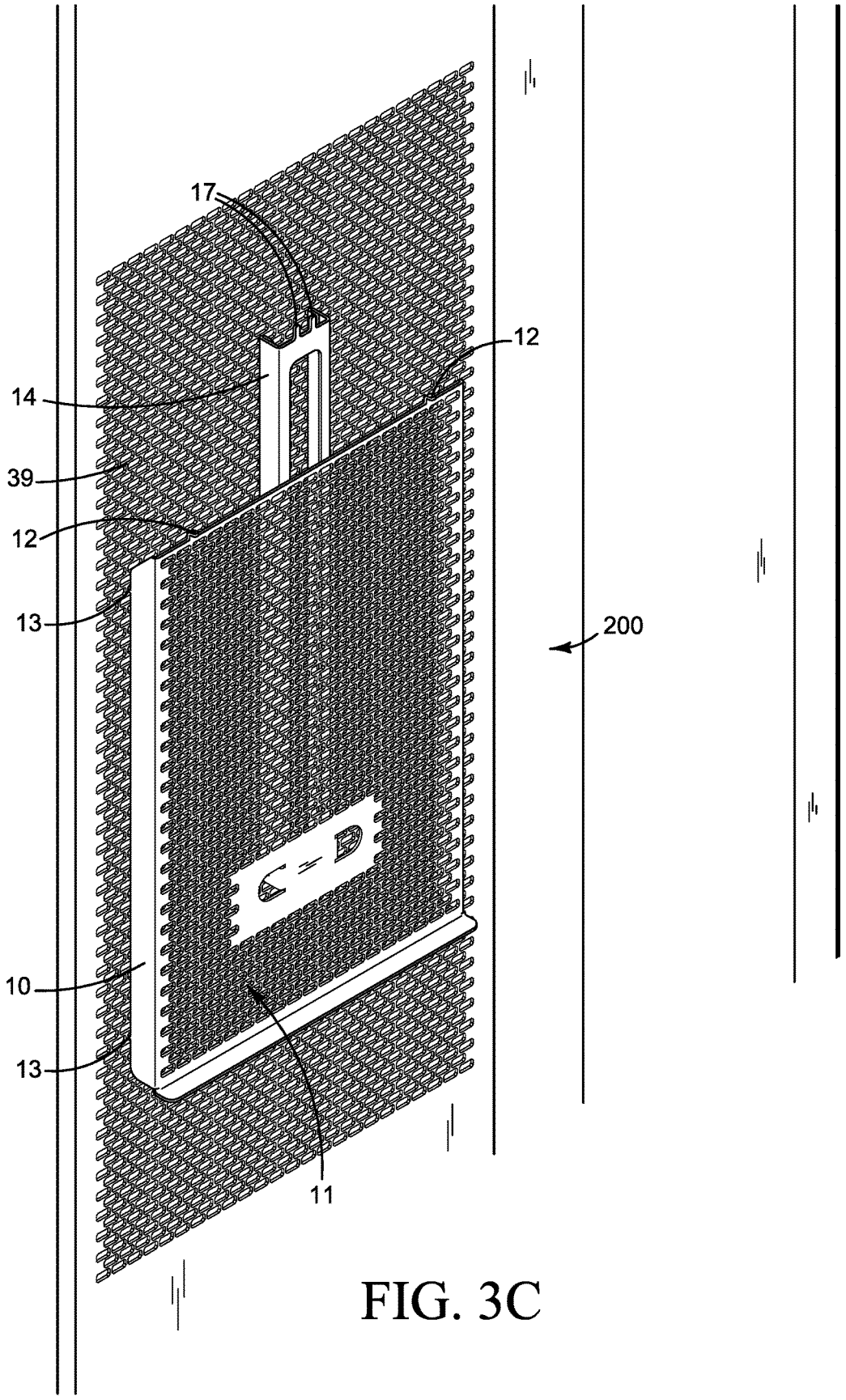

FIGS. 3A-3C are schematic views illustrating the shelving apparatus of FIG. 2 in a plurality of shelf positions, respectively, according to examples. For example, the plurality of shelf positions may include an extended shelf position (FIG. 3A), an intermediate shelf position (FIG. 3B), and a shelf storage position (FIG. 3C). The shelving apparatus 200 may include the shelf 10 and the kickstand member 14 as previously discussed with respect to the shelving apparatuses 100 and 200 of FIGS. 1 and 2.

Referring to FIG. 3A, in some examples, the shelf surface 11 is placed in the extended shelf position. For example, the first set of shelf connectors 12 are attached to the perforated member 39 such as a rack door. Also, the kickstand member 14 is placed in the extended kickstand position by a rotation of the kickstand member 14 with respect to the shelf 10. The extended shelf position may correspond to the shelf surface 11 disposed in a horizontal orientation. The extended kickstand position may correspond to the kickstand member 14 in an inclined orientation with respect to the perforated member 39. For example, the kickstand member 14 is placed in an inclined orientation between the perforated member 39 and the shelf 10 to provide support for the shelf 10 and objects placed thereon. At least one kickstand connector 17 is connected to the perforated member 39. In the extended kickstand position, the shelf surface 11 may receive objects such as computers and be used thereon by users. For example, the computers may include laptop computers, notebook computers, and the like.

Referring to FIG. 38, in some examples, the shelf surface 11 is placed in the intermediate shelf position. For example, the first set of shelf connectors 12 are attached to the perforated member such as a rack door. Also, the kickstand member 14 is placed in the intermediate kickstand position by a rotation of the kickstand member 14 with respect to the shelf 10. For example, the kickstand member 14 is placed in an inclined orientation between the perforated member 39 and the shelf 10 to provide support for the shelf 10 and objects placed thereon. At least one kickstand connector 17 is connected to the perforated member 39.

Referring to FIG. 3B, in some examples, in the inclined orientation the kickstand member 14 is positioned to enable the shelf surface 11 to extend outward and slope downward to enable objects to be placed on the shelf surface 11 in a slanted manner. Thus, objects such as tablet computers may be placed on the shelf surface 11 in a slanted manner and used thereon by a user. For example, placement of the tablet computer in a slanted manner may increase the operability of it and provide the user with a pleasant user experience.

Referring to FIG. 3C, in some examples, the shelf surface 11 is placed in the shelf storage position. For example, the second set of shelf connectors 13 are connected to the perforated member 39 such as a rack door. Also, the kickstand member 14 is placed in the kickstand storage position by a rotation of the kickstand member 14 with respect to the shelf 10. The shelf storage position may correspond to the shelf surface 11 disposed in a vertical orientation. The kickstand storage position may correspond to the kickstand member 14 disposed in a vertical orientation. In the shelf storage position, objects are not placed on the shelf surface 11 and the shelf apparatus 200 is conveniently stored against the perforated member such as a rack door.

Figure 4A:
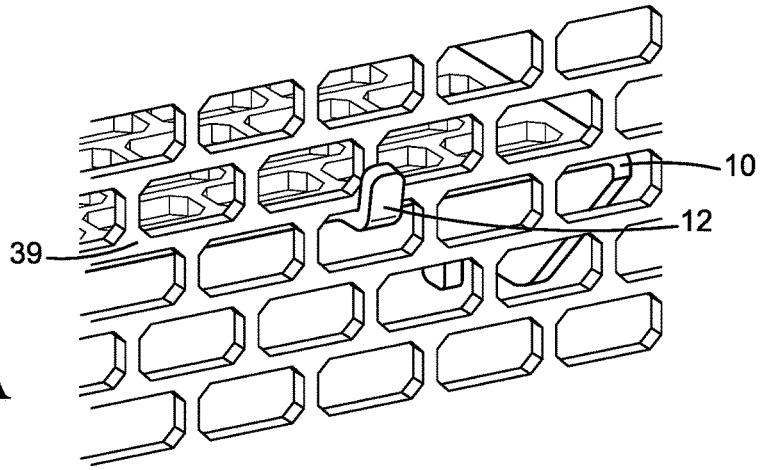
FIG. 4A is an exploded view illustrating an engagement of one of a first set of shelf connectors of the shelving apparatus of FIG. 2 according to an example.

FIG. 4A is an exploded view illustrating an engagement of one of a first set of shelf connectors of the shelving apparatus of FIG. 2 according to an example. In some examples, the first set of shelf connectors 12 includes a plurality of hooks to grab the perforated member 39 in the extended shelf position and the intermediate shelf position. Also, the plurality of hooks releases the perforated member 39 in the shelf storage position. For example, the weight of the shelf 10 and/or objects placed therein, and the shape of the first set of shelf connectors 12 may enable the first set of shelf connectors 12 to contact the perforated member 39 and assist in supporting the shelf 10. In some examples, the first set of shelf connectors 12 may include two shelf connectors.

Figure 4B:
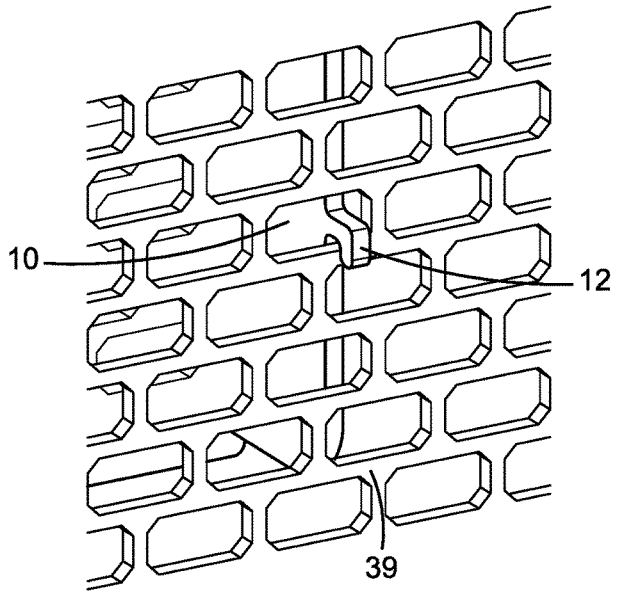
FIG. 4B is an exploded view illustrating an engagement of one of a second set of shelf connectors of the shelving apparatus of FIG. 2 according to an example.

FIG. 4B is an exploded view illustrating an engagement of one of a second set of shelf connectors of the shelving apparatus of FIG. 2 according to an example. The second set of shelf connectors 13 includes a plurality of tab members to rest against the perforated member 39 in the shelf storage position, and be removed from and/or release the perforated member 39 in the extended shelf position and the intermediate shelf position. For example, the weight of the shelf 10 and the shape of the second set of shelf connectors 12 may enable the second set of shelf connectors 13 to contact the perforated member 39 and assist in supporting the shelf 10, for example, in a vertical orientation. In some examples, the second set of shelf connectors 13 may include four shelf connectors.

Figure 4C:
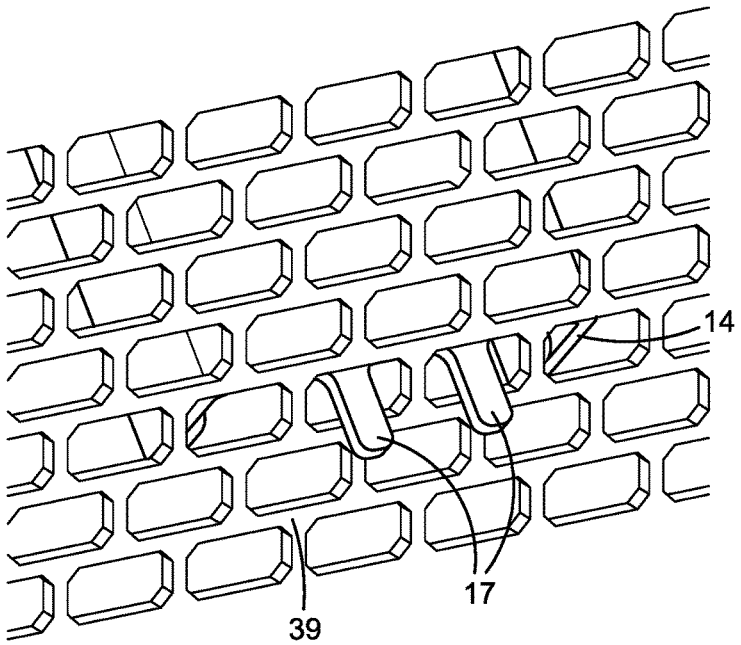
FIG. 4C is an exploded view illustrating an engagement of kickstand connectors of the shelving apparatus of FIG. 2 according to an example.

FIG. 4C is an exploded view illustrating an engagement of kickstand connectors of the shelving apparatus of FIG. 2 according to an example. In some examples, at least one kickstand connector 17 may include a hook to grab the perforated member 39 in the extended shelf position and the intermediate shelf position. Also, the hook releases the perforated member 39 in the shelf storage position. In some examples, the kickstand member 14 may include two kickstand connectors 17.

Figure 5:
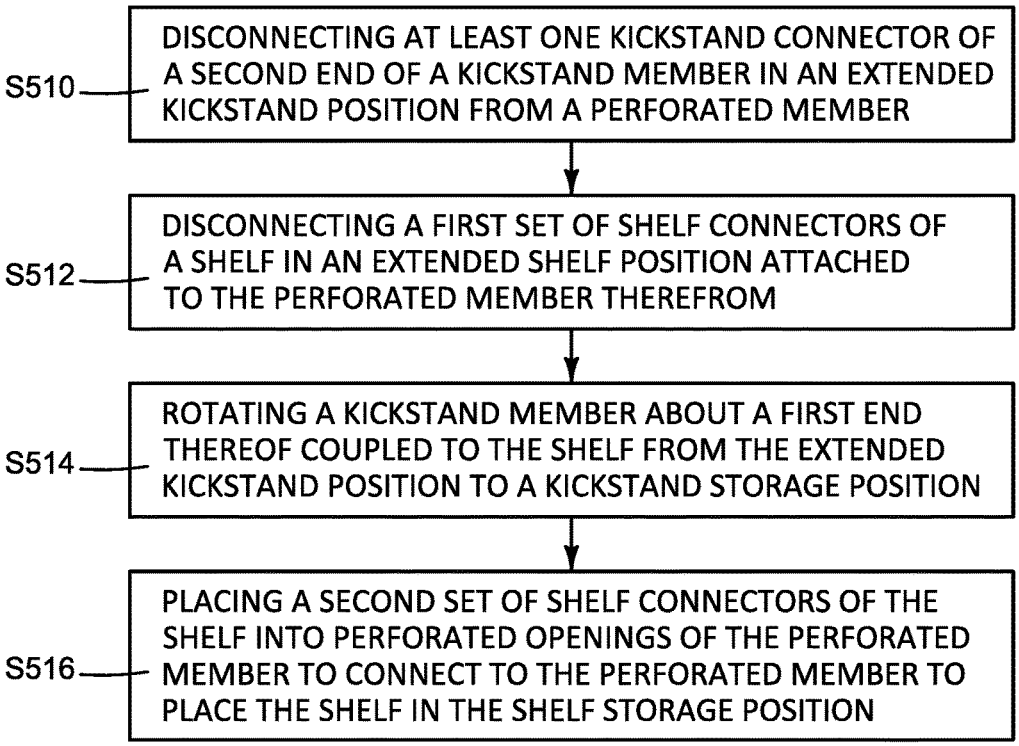
FIG. 5 is a flowchart illustrating a shelf adjustment method according to an example.

FIG. 5 is a flowchart illustrating a shelf adjustment method according to an example. In some examples, the modules, assemblies, and the like, previously discussed with respect to FIGS. 1-4C may be used to implement the method of FIG. 5. Referring to FIG. 5, in block S510, at least one kickstand connector of a second end of a kickstand member in an extended kickstand position is disconnected from a perforated member. For example, the perforated member may include a rack door. In block S512, a first set of shelf connectors of a shelf in an extended shelf position attached to the perforated member is disconnected therefrom. In block S514, a kickstand member is rotated about a first end thereof coupled to the shelf from an extended kickstand position to a kickstand storage position.

For example, the kickstand member may be rotated about the first end thereof coupled to the shelf into an area to receive the kickstand member disposed between a plurality of side rails attached to and extending outward from the shelf. In some examples, the shelf may be disposed in a horizontal position in the extended shelf position and in a vertical orientation in the shelf storage position. In block S516, a second set of shelf connectors of the shelf is placed into perforated openings of the perforated member to connect to the perforated member to place the shelf in a shelf storage position.

Figure 6:
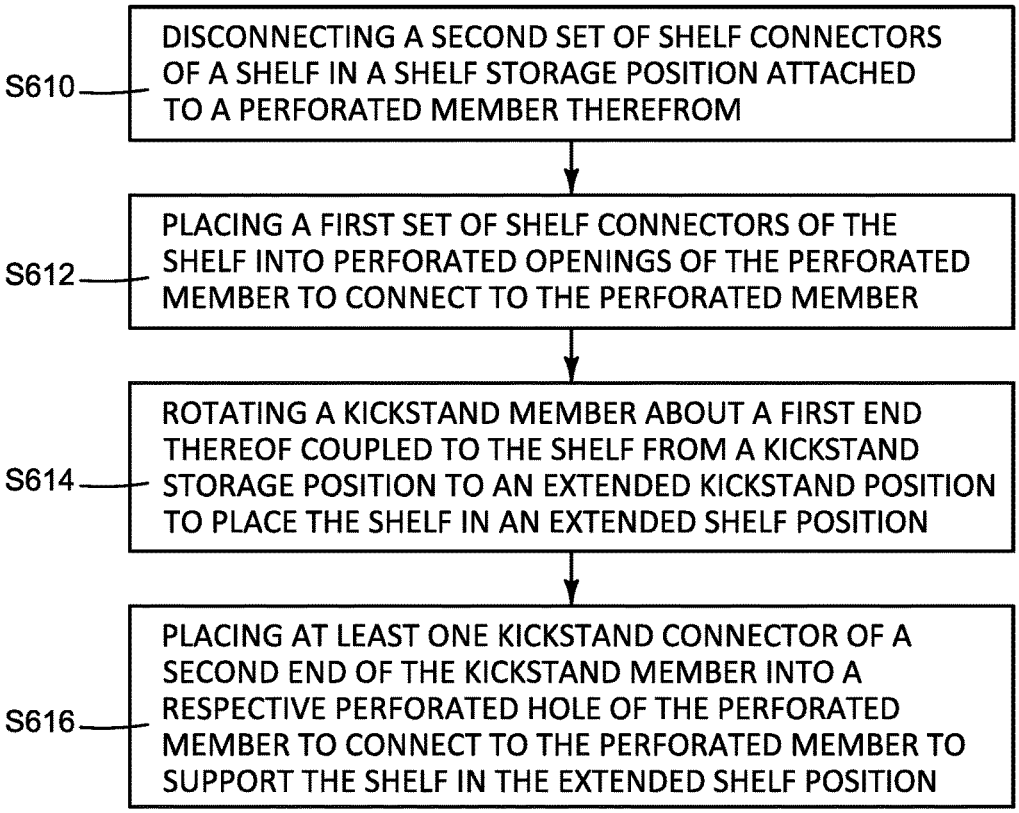
FIG. 6 is a flowchart illustrating a shelf adjustment method according to an example.

FIG. 6 is a flowchart illustrating a shelf adjustment method according to an example. In some examples, the modules, assemblies, and the like, previously discussed with respect to FIGS. 1-4C may be used to implement the method of FIG. 6. Referring to FIG. 6, in block S610, a second set of shelf connectors of a shelf in a shelf storage position attached to a perforated member is disconnected therefrom. In block S612, a first set of shelf connectors of the shelf is placed into perforated openings of the perforated member to connect to the perforated member. In block 5614, a kickstand member is rotated about a first end thereof coupled to the shelf from a kickstand storage position to an extended kickstand position to place the shelf in an extended shelf position.

For example, the kickstand member is rotated about the first end thereof coupled to the shelf from an area disposed between a plurality of side rails attached to and extending outward from the shelf to the extended kickstand position. In block S616, at least one kickstand connector of a second end of the kickstand member is placed into a respective perforated hole of the perforated member to connect to the perforated member to support the shelf in the extended shelf position. In some examples, the shelf may be disposed in a horizontal position in the extended shelf position and in a vertical orientation in the shelf storage position.

It is to be understood that the flowcharts of FIGS. 5 and 6 illustrate architecture, functionality, and/or operation of examples of the present disclosure. Although the flowcharts of FIGS. 5 and 6 illustrate a specific order of execution, the order of execution may differ from that which is depicted. For example, the order of execution of two or more blocks may be rearranged relative to the order illustrated. Also, two or more blocks illustrated in succession in FIGS. 5 and 6 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A shelving apparatus, comprising:

a shelf movable between a plurality of shelf positions including an extended shelf position and a shelf storage position; the shelf including a shelf surface, a first set of shelf connectors, and a second set of shelf connectors;

the first set of shelf connectors removably couples to a perforated member in the extended shelf position; and the second set of shelf connectors removably couples to the perforated member in the shelf storage position; and a kickstand member movable between a plurality of kickstand positions including an extended kickstand position and a kickstand storage position, the kickstand member having a first end and a second end;

the first end to couple to the shelf; and the second end having at least one kickstand connector to removably couple to the perforated member.

2. The shelving apparatus of claim 1 wherein the shelf surface is placed in the extended shelf position in response to a placement of the kickstand member in the extended kickstand position by a rotation of the kickstand member with respect to the shelf.

3. The shelving apparatus of claim 1 wherein the shelf surface is placed in the shelf storage position in response to a placement of the kickstand member in the kickstand storage position by a rotation of the kickstand member with respect to the shelf.

4. The shelving apparatus of claim 1, wherein the extended shelf position corresponds to the shelf surface disposed in a horizontal orientation and the shelf storage position corresponds to the shelf surface disposed in a vertical orientation.

5. The shelving apparatus of claim 1, wherein the extended kickstand position corresponds to the kickstand member disposed in an inclined orientation with respect to the perforated member and the kickstand storage position corresponds to the kickstand member disposed in a vertical orientation.

6. The shelving apparatus of claim 1, wherein the shelf further comprises:

a plurality of side rails attached to and extending outward from the shelf surface, the side rails and the shelf surface forming an area to receive the kickstand member in the kickstand storage position.

7. The shelving apparatus of claim 6, wherein the shelf further comprises:

a front rail attached to and extending outward from the shelf surface in a direction opposite from the side rails disposed along opposite ends of the shelf surface; and a plurality of flanges extending outward from the shelf surface to connect to the first end of the kickstand member.

8. The shelving apparatus according to claim 1, wherein:

the first set of shelf connectors includes a plurality of hooks to grab the perforated member in the extended shelf position and release the perforated member in the shelf storage position;

the second set of shelf connectors includes a plurality of tab members to rest against the perforated member in the shelf storage position; and the at least one kickstand connector includes a hook member to grab the perforated member in the extended kickstand position and release the perforated member in the kickstand storage position.

9. The shelving apparatus of claim 1, wherein the plurality of shelf positions further comprises:

an intermediate shelf position corresponding to the shelf surface arranged in an inclined orientation with respect to the perforated member.

10. The shelving apparatus of claim 9, wherein the plurality of kickstand positions further comprises:

an intermediate kickstand position corresponding to the kickstand member arranged in an inclined orientation with respect to the perforated member such that the shelf surface is placed in the intermediate shelf position in response to a placement of the kickstand member in the intermediate kickstand position by a rotation of the kickstand member with respect to the shelf.

11. The shelving apparatus of claim 1, wherein the shelf surface comprises a perforated surface.

12. A shelf adjustment method comprising:

disconnecting at least one kickstand connector of a second end of a kickstand member in an extended kickstand position from a perforated member;

disconnecting a first set of shelf connectors of a shelf in an extended shelf position attached to the perforated member therefrom;

rotating a kickstand member about a first end thereof coupled to the shelf from an extended kickstand position to a kickstand storage position; and placing a second set of shelf connectors of the shelf into perforated openings of the perforated member to connect to the perforated member to place the shelf in a shelf storage position.

13. The shelf adjustment method of claim 12, wherein the rotating a kickstand member about a first end thereof coupled to the shelf from an extended kickstand position to a kickstand storage position further comprises:

rotating the kickstand member about the first end thereof coupled to the shelf into an area to receive the kickstand member disposed between a plurality of side rails attached to and extending outward from the shelf.

14. A shelf adjustment method comprising:

disconnecting a second set of shelf connectors of a shelf in a shelf storage position attached to a perforated member therefrom;

placing a first set of shelf connectors of the shelf into perforated openings of the perforated member to connect to the perforated member;

rotating a kickstand member about a first end thereof coupled to the shelf from a kickstand storage position to an extended kickstand position to place the shelf in an extended shelf position; and placing at least one kickstand connector of a second end of the kickstand member into a respective perforated hole of the perforated member to connect to the perforated member to support the shelf in the extended shelf position.

15. The shelf adjustment method of claim 14, wherein the rotating a kickstand member about a first end thereof coupled to the shelf from a kickstand storage position to an extended kickstand position to place the shelf in an extended shelf position further comprises:

rotating the kickstand member about the first end thereof coupled to the shelf from an area disposed between a plurality of side rails attached to and extending outward from the shelf to the extended kickstand position.

* * * * *